US008251737B2

(12) United States Patent
Van Stiphout et al.

(10) Patent No.: US 8,251,737 B2
(45) Date of Patent: Aug. 28, 2012

(54) TERMINAL BLOCK FOR A CABLE CONNECTOR

(75) Inventors: Nico Van Stiphout, Beek En Donk (NL); Ton Karsmakers, Oss (NL); Jeroen De Bruijn, Loon Op Zand (NL)

(73) Assignee: FCI, Guyancourt (FR)

( * ) Notice: Subject to any disclaimer, the term of this patent is extended or adjusted under 35 U.S.C. 154(b) by 0 days.

(21) Appl. No.: 12/998,933

(22) PCT Filed: Dec. 19, 2008

(86) PCT No.: PCT/IB2008/055687

§ 371 (c)(1),
(2), (4) Date: Jun. 17, 2011

(87) PCT Pub. No.: WO2010/070397

PCT Pub. Date: Jun. 24, 2010

(65) Prior Publication Data

US 2011/0250782 A1 Oct. 13, 2011

(51) Int. Cl.
*H01R 11/20* (2006.01)

(52) U.S. Cl. ..... 439/404

(58) Field of Classification Search ..... 439/404, 439/405, 397

See application file for complete search history.

(56) References Cited

U.S. PATENT DOCUMENTS

| | | | | |
|---|---|---|---|---|
| 5,099,570 | A | 3/1992 | Gerhard, Jr. | 29/751 |
| 5,581,879 | A | 12/1996 | Tsuji et al. | 29/861 |
| 6,540,544 | B1 | 4/2003 | Akeda | 439/395 |
| 7,156,689 | B2 * | 1/2007 | Fabian et al. | 439/417 |
| 7,381,097 | B2 * | 6/2008 | Ellis et al. | 439/676 |
| 7,407,406 | B2 * | 8/2008 | Arlitt et al. | 439/404 |
| 7,503,798 | B2 * | 3/2009 | Hashim | 439/405 |
| 7,530,836 | B2 * | 5/2009 | Cox et al. | 439/409 |
| 2002/0048997 | A1 | 4/2002 | Siemon | 439/625 |
| 2007/0184725 | A1 | 8/2007 | Hashim | 439/676 |
| 2008/0003877 | A1 | 1/2008 | Siev et al. | 439/607 |
| 2009/0269969 | A1 * | 10/2009 | Siev et al. | 439/404 |

* cited by examiner

*Primary Examiner* — Neil Abrams
*Assistant Examiner* — Phuongchi Nguyen
(74) *Attorney, Agent, or Firm* — Harrington & Smith

(57) ABSTRACT

Terminal block for a cable connector including insulation displacement contact slots at both sides wherein at least a part of the insulation displacement contact slots at one side of the terminal block are paired either by a corresponding insulation displacement contact slot or by a punch support at the opposite side of the terminal block. The punch supports can be provided with a cylindrical curvature with a radius corresponding to the radius of a cable to be punched.

12 Claims, 3 Drawing Sheets

TERMINAL BLOCK FOR A CABLE CONNECTOR

FIELD OF THE INVENTION

The instant invention relates to a terminal block for a cable connector comprising cavities for insulation displacement contacts. The invention also relates to a connector comprising such a terminal block.

BACKGROUND OF THE INVENTION

An insulation displacement connectors are a connector that implement electrical contacts adapted to pierce or cut the insulation sheath on a cable to make the connection with the cable wire.

Such connectors typically comprise a housing or terminal block having short open-ended slots that receive corresponding insulation displacement contacts which contain sharp metal blades. These blades are adapted to cut through the insulation sheath of a cable when the latter is punched into the slot. These blades hold the cable in position and make electrical contact with the electro-conductive wire of the cable.

A punch tool or punch down tool is typically used to push the cable laterally (i.e. perpendicularly to the cable axis) into the slot. A suitable punch tool is disclosed in U.S. Pat. No. 5,099,570. To use the punch tool, a cable is inserted in between two metal blades of an insulation displacement connector and the punch tool is pressed down onto the cable and the two blades until the cable is stripped and electrical contact is made with the electro-conductive wire of the cable as it is pushed between the blades.

When a cable is punched laterally into an insulation displacement connector slot, a force is exerted onto the terminal block, which needs to be balanced. Otherwise the terminal block may be damaged. Particularly if the slot is close to a side end of the terminal block, the terminal block can bend under the action of the exerted punch force.

SUMMARY OF THE INVENTION

It is an object of the invention to provide a terminal block allowing punching of one or more cables without the need to use an additional support to balance exerted punch forces.

This object of the invention is achieved with a terminal block according to claim 1.

Where the terminal block has two paired slots at opposite sides, two cables can simultaneously be punched into the slots by a punch tool, having two punching extremities which can be moved towards and away from each other at the same time. The same punch tool can be used for punching a cable into an insulation displacement contact slot which is paired with a punch support at the opposite side of the terminal block. While one of the punch tool extremities acts on the cable, the other punch tool extremity acts on the punch support. This way, the punch forces are balanced and no bending moments are induced into the terminal block.

The punch support may for example be a bulge, integrally formed with the terminal block, having cylindrical wall parallel to the opposite insulation displacement contact and curved with a radius corresponding to the radius of a cable to be punched. For instance, the radius may be equal +/−10% of the radius of a cable to be punched. The terminal block may for example comprise a back bone plate or partition having the punch supports and insulation displacement contacts at both sides. According to a preferred embodiment, the largest distance between the cylindrical wall of the punch support and the back bone plate corresponds to the largest distance between the punched cable and the back bone partition.

The terminal block may for example comprise at both sides a row of insulation displacement contact slots with a punch support between each pair of insulation displacement contact slots. Each punch support may be paired with an insulation displacement contact slot at the opposite side of the terminal block.

Optionally, one or more of the punch supports may be provided with a curved punch surface. The punch surface may for example be curved with a radius corresponding to the radius of a cable to be attached. This way, a punch tool can be used having two extremities movable in line with each other, the extremities having concave contact faces, which can act on either a cable to be punched or onto the punch support. This provides a better punching contact between the punch tool and the cable or the punch support.

The aforementioned object of the invention is also achieved with a cable connector comprising one or more terminal blocks as disclosed.

The aforementioned object of the invention is also achieved with a method of punching a cable into an insulation displacement contact slot in a terminal block of a cable connector, using a punch tool having a first extremity pushing the cable into the slot, while a second extremity of the punch tool acts on an opposite side of the terminal block to balance the exerted forces.

BRIEF DESCRIPTION OF THE DRAWINGS

The present invention will be further explained with reference to the figures wherein.

DETAILED DESCRIPTION OF EMBODIMENTS

Figures 1, 4:
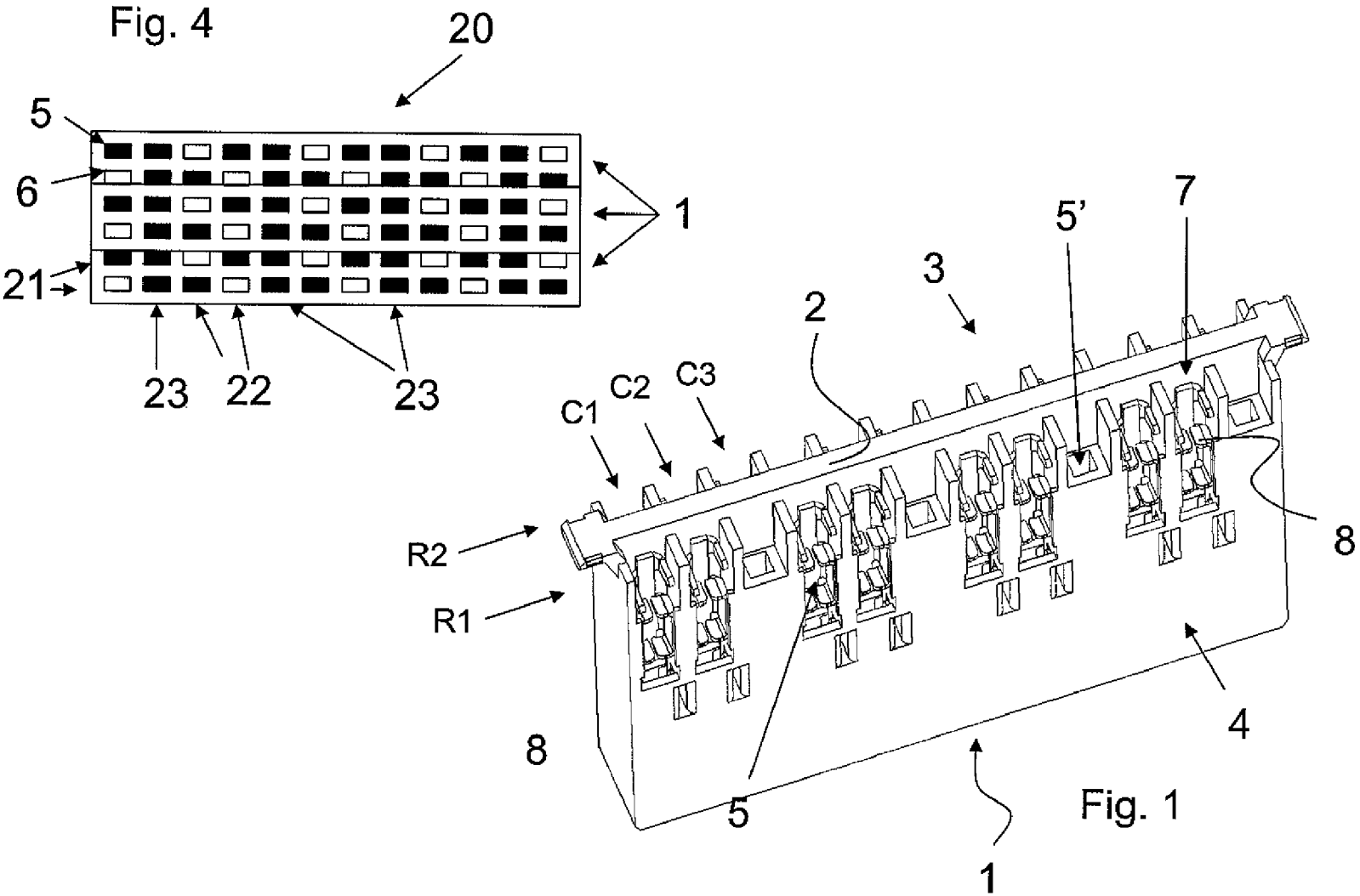
FIG. 1: shows a terminal block according to the present invention.
FIG. 4: shows schematically a front view of a connector according to the invention comprising three terminal blocks.
Figure 2:
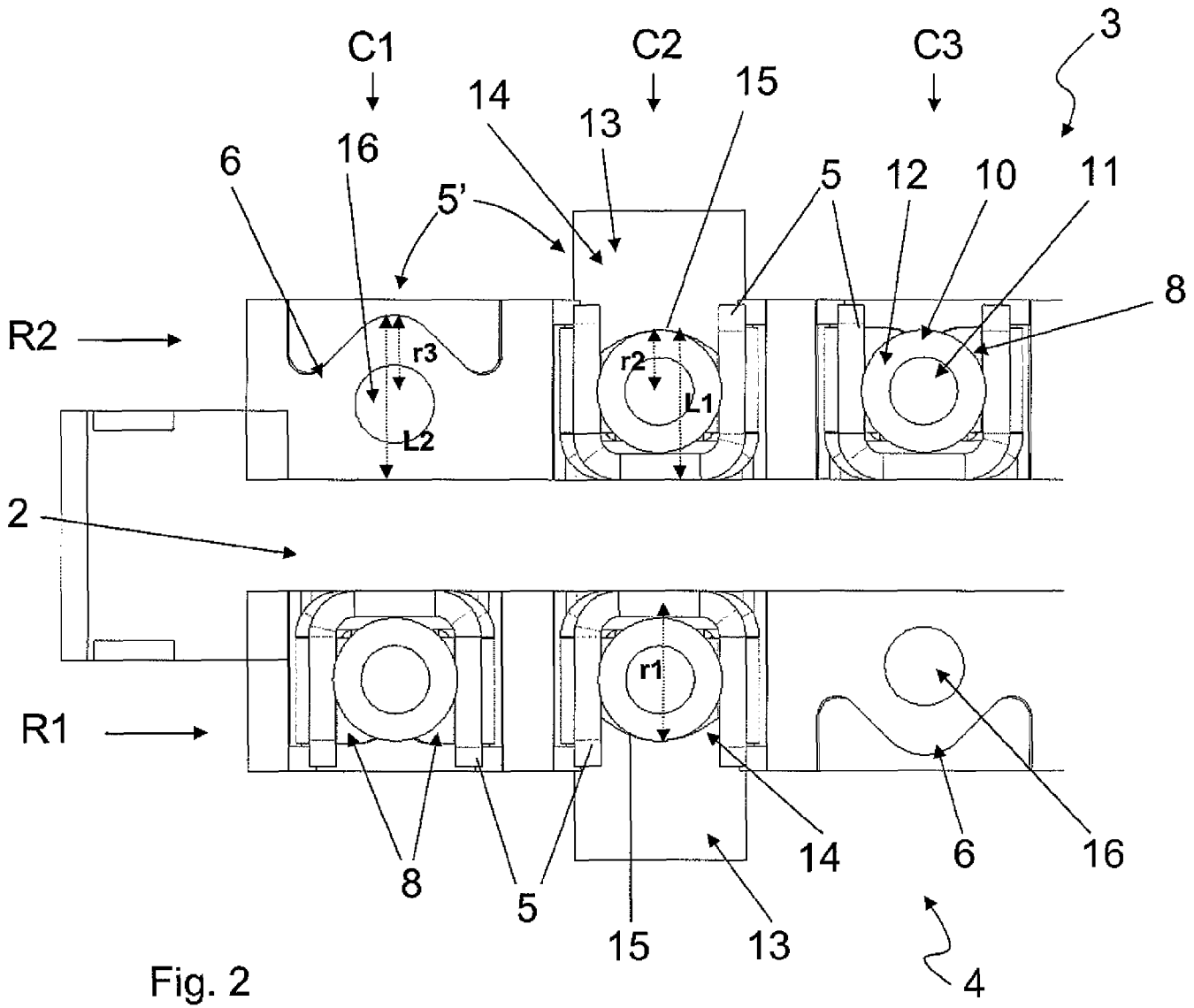
FIG. 2: shows in plan view the terminal block of FIG. 1 with a punch tool punching a cable.

FIG. 1 shows a perspective view of a terminal block 1 of the prior art. The terminal block 1 comprises a back bone plate 2. At both sides 3, 4 of the back bone plate 2, the terminal block 1 comprises a number of insulation displacement contacts 5 accommodated in corresponding insulation displacement contact receiving slots 5'. As shown in FIGS. 1 and 2, in the terminal block 1, the slots 5' are arranged in a matrix of two rows and a plurality of columns. The insulation displacement contacts are arranged in row wise pairs in the slots of the matrix, such that, in a first row R1, a first pair of contacts 5 are accommodated in slots 5' of a first column C1 and of a second column C2 of the matrix and, in a second row R2, adjacent to the first row R1, a second pair of contacts 5 are received in slots 5' of the same second column C2 and of a third column C3 of the matrix. In other words, the various contact pairs are arranged in a staggered fashion as disclosed in the PCT application (PCT/IB2007/052716) which is incorporated by reference.

With reference to FIG. 2, is shown a terminal block according to the invention. The insulation displacement contact slots 5' at one side 3, 4 of the back bone plate 2 are paired either by a corresponding insulation displacement contact 5' or by a punch support 6 at the opposite side of the terminal block 1.

The insulation displacement contacts 5 have two pairs of sharp metal blades 8 which are adapted to cut through the insulation sheath of a cable when it is punched into the insulation displacement contact 5. These blades 8 hold the cable in position and make electrical contact with the electro-conductive core of the cable. The metal blades 8 are operatively connected to further electronic circuitry (not shown).

Figure 3:
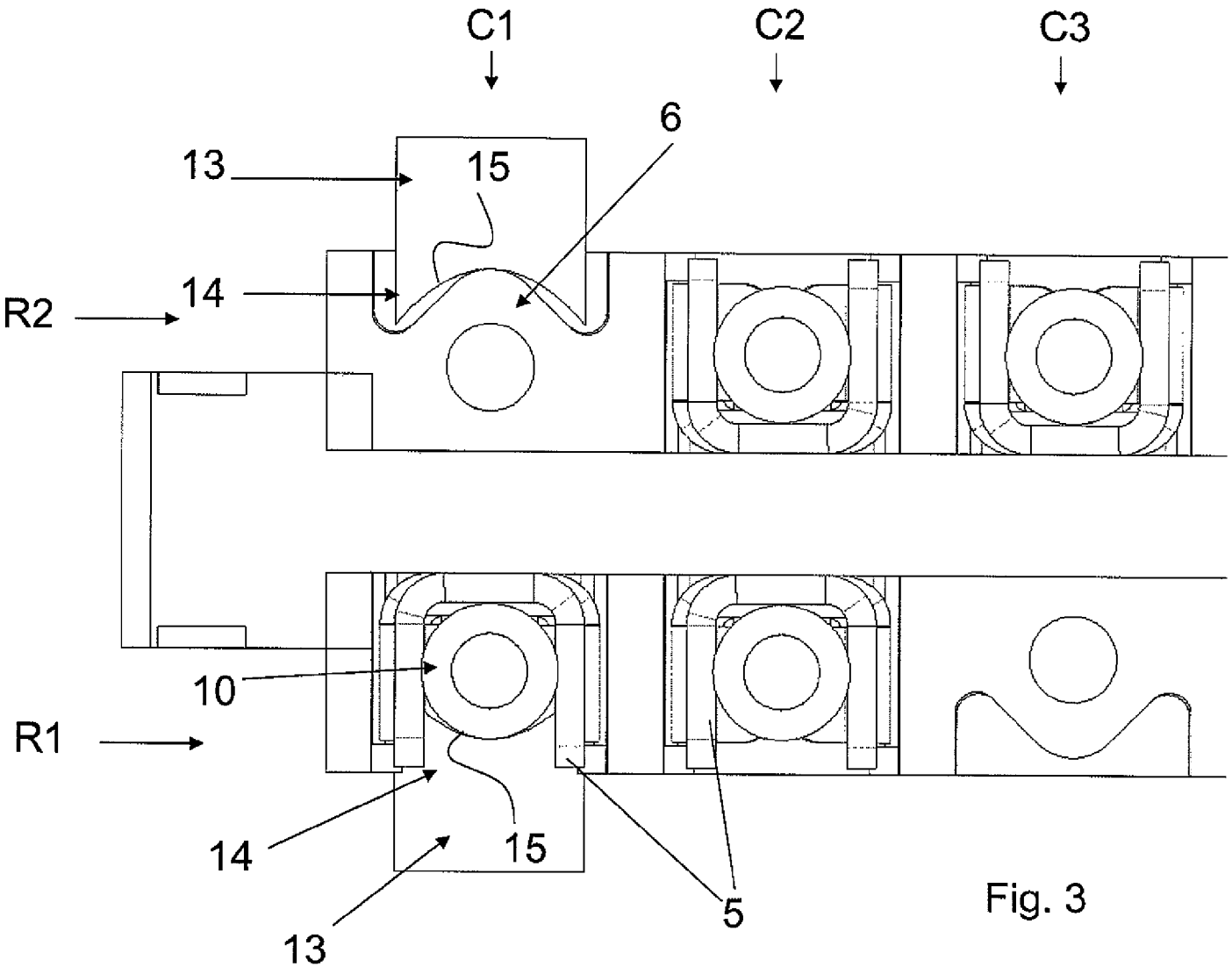
FIG. 3: shows in plan view the terminal block of FIG. 1 with a punch tool punching two cables.

FIGS. 2 and 3 show one extremity of the terminal block 1 schematically in plan view, with cables 10 punched into the insulation displacement contact slots 5' such that the cable, comprising an electro-conductive wire core 11 insulated by a thermoplastic insulating sheath 12, is forced down between the pairs of blades 8 so as to cut the insulating sheath 12. Two cables 10 may be simultaneously punched in two opposite insulation displacement contact slots 5 by a punch tool 13 having two opposite extremities 14 which are moveable in line with each other. The punching force exerted onto one cable 10 balances the punching force exerted onto the opposite cable 10. The extremities 14 are provided with concave punch faces 15 curved with a radius r1. The cables 10 have a radius r2 which is smaller than the radius r1 of the punch faces 15. The punch supports 6 have a hollow core 16, so as to provide more flexibility to the punch supports 6 and in order to absorb to some extent (for instance in the range of the tolerances) the stroke of the punch tool 13.

The insulation displacement contact slots 5', located in coordinate (R1,C1), is positioned opposite to a punch support 6 formed in the insulation displacement contact slot 5' located in coordinate (R2,C1). The punch supports 6 are formed as a longitudinal bulge parallel to the insulation displacement contact slots 5'. The punch supports 6 have a cylindrical surface with a radius r3 corresponding substantially to the radius r2 of a cable 10.

The largest distance L2 between the cylindrical wall of the punch support and the back bone plate 2 corresponds to the largest distance L1 between the punched cable 10 and the back bone partition 2.

FIG. 3 shows the situation, where a cable 10 is punched into an insulation displacement contact slot 5' in position (R1,C1) which is opposite to the insulation displacement contact slot 5' located in coordinate (R2,C1) having a punch support 6. One of the extremities 14 of the punch tool 13 acts on the cable 10, while the other extremity 14 of punch tool 13 acts on the punch support 6. The two exerted punching forces balance one another.

FIG. 4 shows schematically a connector 20 built of three stacked terminal blocks 1. The terminal blocks 1 comprise two rows 21 of insulation displacement contact slots 5'. Between each pair of insulation displacement contact slots 5 is a punch support 6. Each punch support 6 is paired with an insulation displacement contact slot 5 of the other row 21 of the same terminal block. The position of each punch support 6 corresponds to the position of the punch supports on the other terminal blocks 1. This way, pairs of columns 22 of staggeredly arranged slots 5' and punch supports 6 are between two columns 23 of insulation displacement contact slots 5.

It is to be understood that even though the characteristics and advantages of the present invention have been set forth in the foregoing description, together with details of the structure and function of the invention, the disclosure is illustrative only, and changes may be made in details, especially in matters of shape, size, and arrangement of the parts. For instance, the punch support 6, above described may be an appropriate removable plug that could be inserted or maintained in a wire and contact cavity, or in any other feature, of the terminal block. Advantageously, plugs of this kind allow customization of the cabling or wiring.

The invention claimed is:

1. Terminal block for a cable connector comprising insulation displacement contact slots at both sides and at least one a punch support, wherein at least a part of the insulation displacement contact slots at one side of the terminal block are paired either by a corresponding one of the insulation displacement contact slots or by a corresponding one of the punch support at the opposite side of the terminal block.

2. Cable connector comprising one or more terminal blocks according to claim 1.

3. Punch tool for punching a cable into an insulation displacement contact slot into a terminal block of a cable connector comprising two extremities movable in line with each other to act onto two opposite sides of a terminal block according to claim 1.

4. Punch tool according to claim 3 wherein the two extremities are provided with concave punch faces having a curvature with a radius which is larger than the radius of a cable to be punched.

5. Terminal block for a cable connector comprising insulation displacement contact slots at both sides wherein at least a part of the insulation displacement contact slots at one side of the terminal block are paired either by a corresponding insulation displacement contact slots or by a punch support at the opposite side of the terminal block, wherein the terminal block comprises at both sides a row of insulation displacement contact slots with a punch support between a pair of adjacent insulation displacement contact slots.

6. Terminal block according to claim 5 wherein each punch support is paired with an insulation displacement contact slot at the opposite side of the terminal block.

7. Terminal block for a cable connector comprising insulation displacement contact slots at both sides wherein at least a part of the insulation displacement contact slots at one side of the terminal block are paired either by a corresponding insulation displacement contact slots or by a punch support at the opposite side of the terminal block, wherein at least a part of the punch support is provided with a curved punch surface.

8. Terminal block according to claim 7 wherein the punch surface has a cylindrical curvature with a radius corresponding to the radius of a cable to be punched.

9. Terminal block for a cable connector comprising insulation displacement contact slots at both sides wherein at least a part of the insulation displacement contact slots at one side of the terminal block are paired either by a corresponding insulation displacement contact slots or by a punch support at the opposite side of the terminal block, comprising a back bone plate having the punch supports and insulation displacement contacts at both sides.

10. Terminal block according to claim 9 wherein the largest distance between the cylindrical wall of the punch support and the back bone plate corresponds to the largest distance between the cable punched into an insulation displacement contact slot and the back bone plate.

11. Terminal block for a cable connector comprising a back bone plate having at both sides a row of insulation displacement contact slots with a punch support between each pair of adjacent insulation displacement contact slots, wherein each punch support on one side of the terminal block is paired with an insulation displacement contact slot at the opposite side of the terminal block.

12. Method of punching a cable into an insulation displacement contact slot in a terminal block of a cable connector, using a punch tool having a first extremity pushing the cable into the insulation displacement contact slot, while a second extremity of the punch tool acts on an opposite side of the terminal block to balance the exerted forces.

* * * * *